US008776426B1

(12) United States Patent
Symonds

(10) Patent No.: US 8,776,426 B1
(45) Date of Patent: Jul. 15, 2014

(54) MAGAZINE RELEASE ASSIST TOOL

(71) Applicant: Eric Symonds, Upland, CA (US)

(72) Inventor: Eric Symonds, Upland, CA (US)

( * ) Notice: Subject to any disclaimer, the term of this patent is extended or adjusted under 35 U.S.C. 154(b) by 72 days.

(21) Appl. No.: 13/676,882

(22) Filed: Nov. 14, 2012

(51) Int. Cl.
*F41A 17/38* (2006.01)
*F41A 9/63* (2006.01)

(52) U.S. Cl.
CPC .. *F41A 17/38* (2013.01); *F41A 9/63* (2013.01)
USPC ..... 42/90; 42/50; 42/49.02

(58) Field of Classification Search
CPC ..... F41A 17/38; F41A 9/63
USPC ..... 42/90, 50, 49.02, 70.02, 49.01, 6
See application file for complete search history.

(56) References Cited

U.S. PATENT DOCUMENTS 2,982,043 A * 5/1961 Katz et al. ..... 42/39.5
4,100,694 A * 7/1978 Musgrave ..... 42/90
4,115,943 A * 9/1978 Musgrave ..... 42/90
4,429,479 A * 2/1984 Johnson ..... 42/6
4,799,323 A * 1/1989 Musgrave ..... 42/90
5,519,954 A * 5/1996 Garrett ..... 42/6
5,806,224 A 9/1998 Hager
6,829,855 B2 * 12/2004 Seifert ..... 42/90
7,562,482 B1 7/2009 Johnson
7,921,587 B2 * 4/2011 Mayberry ..... 42/6
7,958,661 B2 * 6/2011 Strayer ..... 42/50
8,151,503 B2 4/2012 Oz
8,191,298 B2 6/2012 Cash et al.
2012/0198742 A1 8/2012 Troy et al.

OTHER PUBLICATIONS www.nationalgunsupply.com, Product: Raddlock Button.
www.nationalgunsupply.com, Product: Prince 50 Bullet Button.
www.nationalgunsupply.com, Product: AR Ring Tool.
www.nationalgunsupply.com, Product: Mag Magnet.
www.nationalgunsupply.com, Product: Wonder Wrench.

* cited by examiner

*Primary Examiner* — Michael David
(74) *Attorney, Agent, or Firm* — Eric Gani

(57) ABSTRACT

A magazine release assist tool is described comprising of a generally U-shaped clip having an integrated arm extension. The tool is used to assist in the release of a magazine from a firearm that is equipped with a magazine release blocking mechanism. The clip is removably secured to the lower receiver of a firearm and the arm extension is provided to form a resilient flat spring having a pivot at its proximate end and a push pin at its distal end. When attached to the firearm, a user can depress the flat spring such that the push pin will engage the magazine release button of the firearm allowing quick removal of the magazine.

18 Claims, 5 Drawing Sheets

MAGAZINE RELEASE ASSIST TOOL

TECHNICAL FIELD

The present invention relates in general to a firearm with a non-removable magazine. More specifically, the invention relates to a magazine release device for a firearm with a non removable magazine

BACKGROUND ART

Gun laws regulate the sale, possession, and use of firearms and ammunition in the United States. In addition to federal gun laws, most states and some local jurisdictions have additionally imposed their own firearms restrictions. California gun laws are known to be some of the strictest in the United States. For example, California put many restrictions on semi-automatic firearms. Essentially, California state laws banned certain firearms by name and characteristics. One of the provisions relates to the detachability of the magazine. Broadly speaking, certain firearms including many semi-automatic rifles that has a detachable magazine are prohibited One method to comply with this legal provision is achieved by the use of a magazine release blocking mechanism or a magazine lock such as a bullet Button®. The bullet Button® modifies a rifle so that the magazine is not removable without the use of a tool i.e. a bullet, a small screwdriver or other tools, which presses the magazine release button that is no longer accessible by a finger. The bullet Button® is a device that is attached to the firearm to replace the standard magazine release button. It is a two piece assembly with an inner button and an outer button. The outer button replaces the standard magazine release button. However, it is stationary and will no longer actuate the spring to allow magazine removal. The inner button sits recessed within the outer button and becomes the actual magazine release button. This configuration does not allow the use of a finger to depress the button. Instead, the use of a tool is required to depress the recessed inner button. The most common tool utilized is a bullet tip, hence the term bullet Button®. Firearms with this feature no longer possess a "detachable magazine" characteristics, and therefore may be exempt depending on the other requirements.

Basically the magazine lock makes it more difficult or slow down the process of changing magazine to conform to certain states and federal law. However this creates a problem in certain occasions where the use of firearm with detachable magazine is legal or when the quick release of the magazine is desired such as in shooting competition as it would be inconvenient to disassemble and reassemble the magazine lock.

Hence, many tools have been devised to make it easier and faster to drop and swap the magazine from a firearm equipped with a magazine lock. Some of the prior art tools include a magnetic button that can be attached to the magazine lock or a wrench that can be screwed in to the magazine lock and many others that do not offer the option to be attached to the magazine lock or the firearm itself. A search of the prior art did not disclose any patents that possess the novelty of the instant invention, however the following U.S. patents are considered related:

| Pat. No. | Inventor | Issue Date |
|---|---|---|
| 2012/0198742 | Troy et al. | Aug. 9, 2012 |
| 8,191,298 | Cash, et al. | Jun. 5, 2012 |
| 8,151,503 | Oz | Apr. 10, 2012 |

-continued

| Pat. No. | Inventor | Issue Date |
|---|---|---|
| 7,562,482 | Johnson | Jul. 21, 2009 |
| 5,806,224 | Hager | Sep. 15, 1998 |

SUMMARY OF THE INVENTION

The present invention discloses a tool that is used to facilitate quick and easy removal of a magazine from a firearm that is equipped with a magazine release blocking mechanism or a magazine lock. The magazine blocking mechanism or magazine lock is used to modify a firearm such that the magazine release button can no longer be accessible by using a finger. This creates a firearm with a non-detachable magazine to comply with certain laws and regulations. A typical magazine lock comprises of a stationary outer button and a recessed inner button which when depressed will release the magazine.

The tool disclosed in the present invention comprises of a generally U-shaped spring clip with an integrated arm extension. The clip is removably secured to the lower receiver of the firearm and is positioned adjacent to the magazine release button. The arm extension protrudes from the clip to form a resilient flat spring with a pivot at its proximate end and a push pin at its distal end. The clip and the arm extension are preferably made of a unitary piece of metal such as for example steel or aluminum.

Once attached on the firearm, the tool can be used to release a magazine from a modified firearm that is equipped with a magazine lock as if one was to use his or her own finger. This is accomplished by simply applying force on the arm extension to allow the push pin to depress the recessed inner button to release the magazine. The tool according to an embodiment of the present invention can be adapted for use on various types of modified firearms that are equipped with a magazine lock including modified firearms with ambidextrous magazine release.

In view of the above disclosure, the primary object of the invention is to provide a magazine release tool that is easy to use, convenient to carry and economical to produce.

Another object of the invention is to provide a magazine release tool that can be adapted for use on various types of firearms.

It is also an object of the invention to provide a magazine release tool that can be adapted for both left handed and right handed individuals.

These and other objects and advantages of the present invention will become apparent from the subsequent detailed description of the preferred embodiment and the appended claims.

BEST MODE FOR CARRYING OUT THE INVENTION

Figure 1:
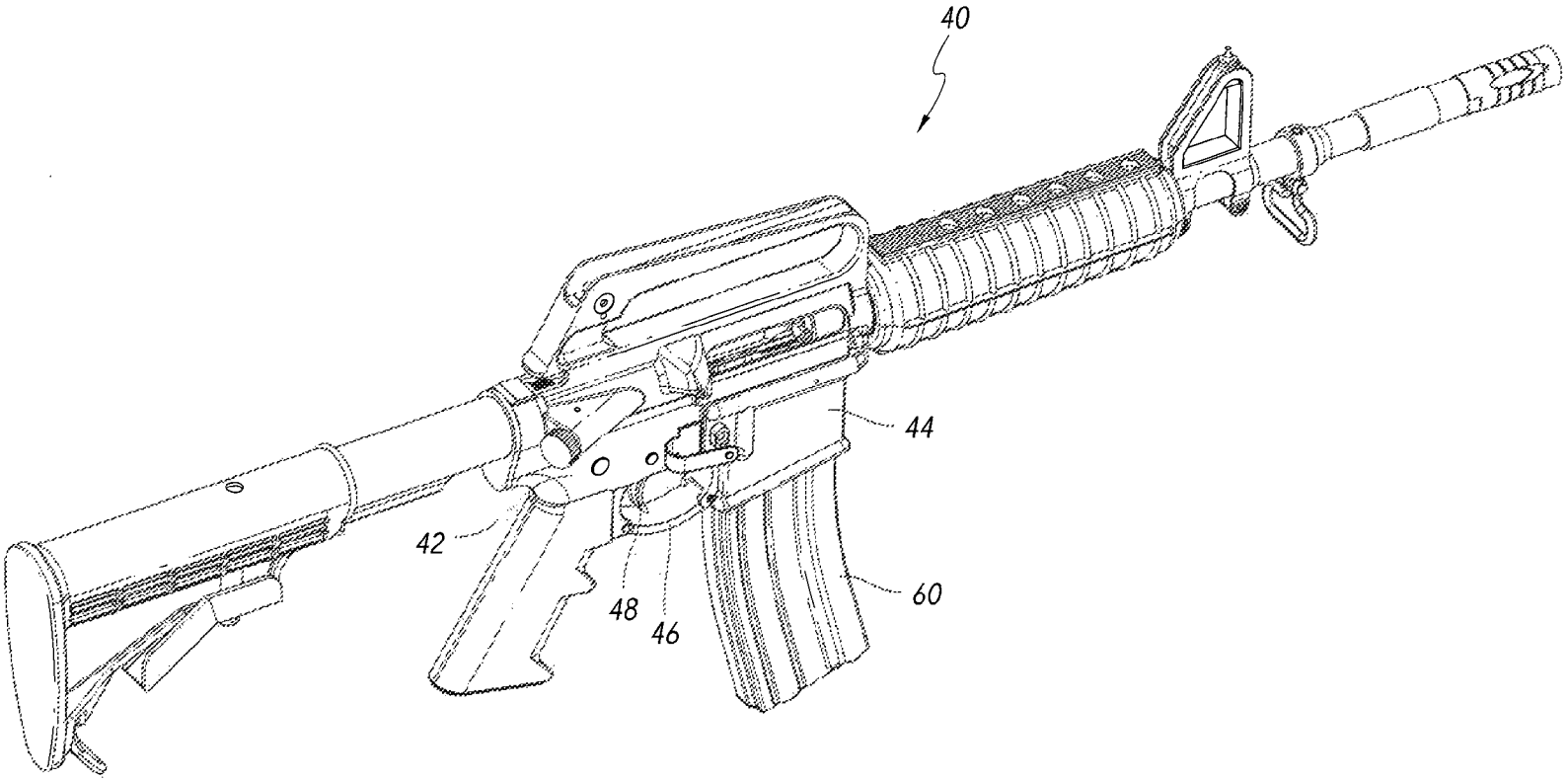
FIG. 1 is a perspective view of an assault rifle showing the magazine release tool according to an embodiment of the present invention being attached to the lower receiver of a firearm.

The best mode of carrying out the invention is presented in terms of a preferred embodiment of a magazine release assist tool 10 herein after referred to as "tool" 10. The tool 10 according to the present invention is used to assist in the release of a magazine 60 from a firearm 40 that is equipped with a magazine release blocking mechanism or a magazine lock 50. Basically, the blocking mechanism 50 is a device that is attached to the firearm 40 to block or to replace the standard magazine release button such that it can only be accessible using a tool instead of a finger. One popular example of a magazine release blocking mechanism 50 is a bullet Button®.

It is to be understood that while the present invention as discussed herein relates in particular to an AR-15 semi-automatic assault rifle, it is not intended to limit the spirit and scope of the present invention solely to this type of firearm. The present invention may find application with many other type of firearms that are equipped with a magazine release blocking mechanism 50 resulting in a modified firearm 40 with a fixed or non-detachable magazine. The orientation of the tool 10 described in the present invention, i.e. left, right, front, rear, top and bottom will follow the orientation of a firearm 40 when held by a user in a shooting position.

The preferred embodiment of the tool 10 comprises of a clip 20 with an integrated arm extension 30 as shown in FIG. 4-11. The tool 10 according to the present invention is formed of a thin strip of metal, such as for example steel or aluminum, bent in substantially perpendicular fashion to form a pair of flat side walls 22, 24 and a base member 26 connecting the two side walls 22, 24 forming a generally U-shaped spring clip 20. The left side wall 22 and the right side wall 24 of the clip 20 are generally square or rectangular in shape and have a top edge, a bottom edge, a front edge and a rear edge. The top edge of the side walls 22 and 24 has a raised lip 28 to facilitate ease of attaching and removing the clip 20 from the firearm 40.

The arm extension 30 is made of the same material as the clip 20 and protrudes from the rear edge of the side wall 24 and is immediately bent to form a curve at its proximate end that serves as a pivot. This configuration results in the arm 30 to form a resilient flat spring 32 that extend generally outwardly in a longitudinal direction towards the magazine release button 52 when the tool 10 is attached on the firearm 40. The arm 30 has a push pin 34 at its distal end that protrudes inwardly facing the firearm 40 and is designed to engage the magazine release button 52 when depressed as shown in FIG. 3 and spring back into the resting position when not in use as shown in FIG. 2.

The tool 10 can be used for a broad range of firearms and in particular the AR-15 or other AR-series assault rifle that are equipped with a magazine release blocking mechanism 50. The arm extension 30 according to the preferred embodiment and as shown in FIGS. 4-11 is disposed on the right side wall 24 of the clip 20. However, according to the alternative embodiment, the arm extension 30 can be configured to be on the left side or on both sides of the clip 20 depending on where the magazine release button 52 is located on a specific modified firearm. It is to be noted that the specific dimension of the clip 20 and the arm extension 30 will depends on the particular firearm that the tool 10 is used on. In general, the clip 20 has a dimension that will result in a snug fit when attached on the lower receiver 42 of a firearm 40 and the arm extension 30 is of a dimension sufficient to provide a spring action and to allow the push pin 34 to engage the magazine release button 52 of a firearm 40.

Figure 2:
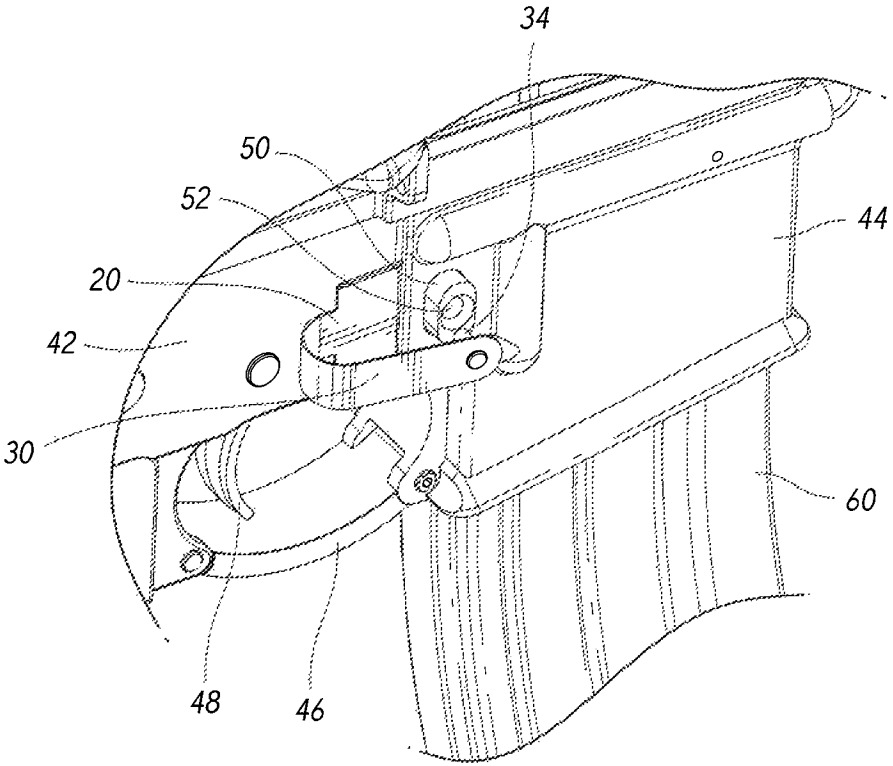
FIG. 2 is a close-up perspective view of the magazine release tool according to an embodiment of the present invention being attached to the lower receiver of a firearm.
Figure 3:
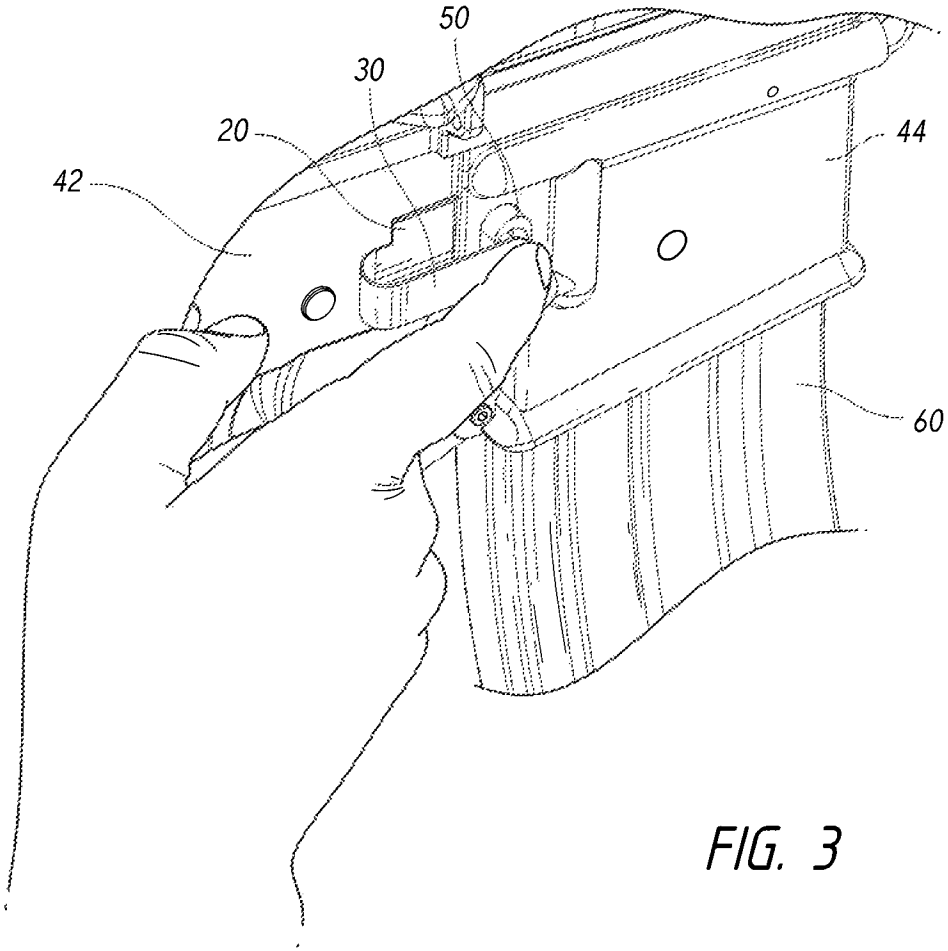
FIG. 3 is a close-up perspective view of the magazine release tool according to an embodiment of the present invention being depressed by a finger to engage the magazine release button.
Figure 4:
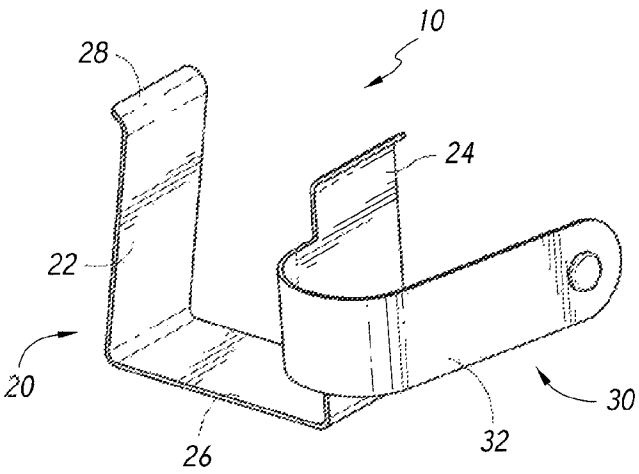
FIG. 4-6 are various perspective views of the magazine release tool according to an embodiment of the present invention.
Figure 5:
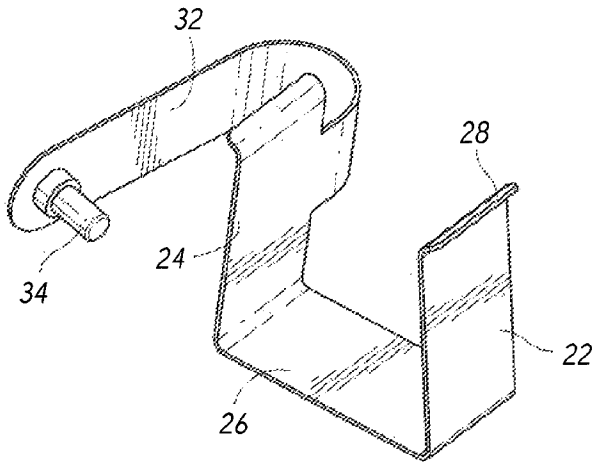
Figure 6:
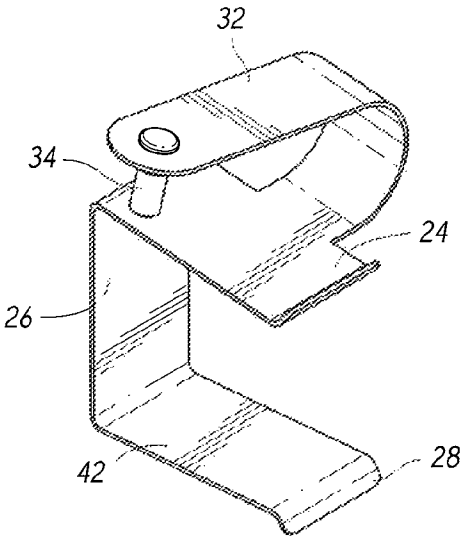
Figure 9:
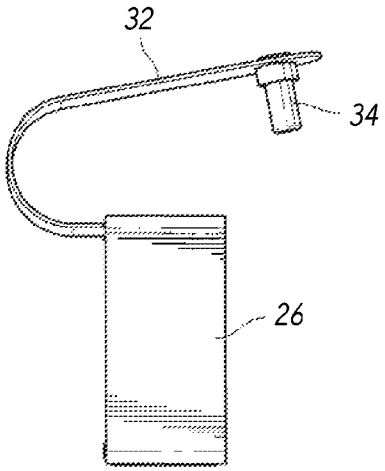
FIGS. 7-11 are various plan views of the magazine release tool according to an embodiment of the present invention.
Figure 8:
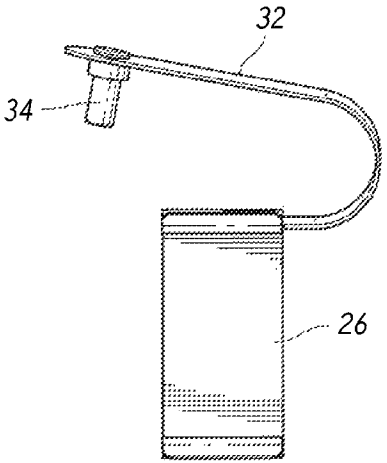
Figure 7:
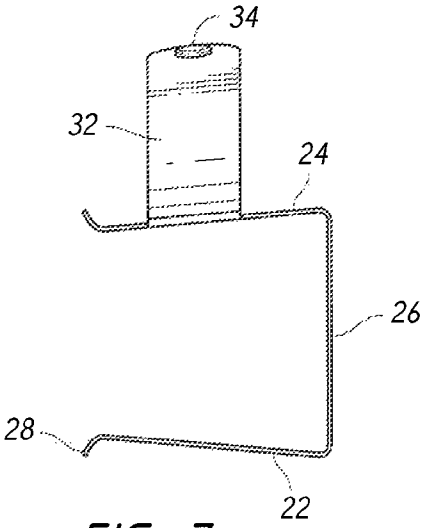
Figure 11:
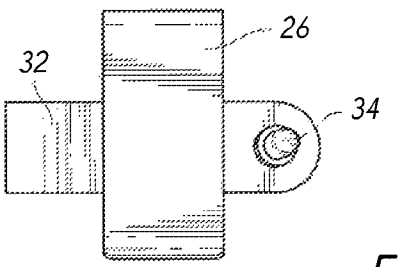
Figure 10:
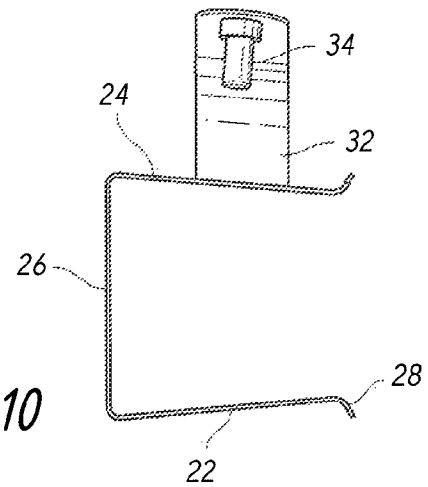

The spring force provided by the side walls 22 and 24 of the clip 20 causes the clip 20 to be removably secured to the lower receiver 42 of the firearm 40 as shown in FIGS. 1-3. The clip 20 is attached to the lower receiver 42 within the trigger guard 46 immediately in front of the trigger 48 as shown in FIG. 2. This will position the tool 10 adjacent to the magazine release button 52. To secure the clip 20, one needs to position the clip 20 at the appropriate position and push the clip 20 upward towards the lower receiver 42 of the firearm 40, similar to the motion when one is to load a magazine 60 into the firearm magazine receiver 44. Once attached to the firearm 40, a user can utilize the tool 10 to quickly unload an empty magazine 60 and replace it with a new loaded magazine 60 as if one was to use his or her own finger. This is accomplished by simply pressing the arm extension 30 inward towards the magazine blocking mechanism 50 as shown in FIG. 3. The push pin 34 is configured such that when the arm extension 30 is depressed against the magazine blocking mechanism 50, the push pin 34 will penetrate and engage the magazine release button 52 that sits recessed within the magazine blocking mechanism 50.

The tool 10 can easily be removed from the firearm 40 by simply pushing the clip 20 downward to let it slide from the bottom end of the lower receiver 42. The prior art tools either do not have the option of being attached to the firearm 40, or when they do, they typically touches the magazine release button 52 that sits recessed within the magazine blocking mechanism 50 when left on the firearm 40. The tool 10 according to the present invention does not touch the inner magazine release button 52 or the outer magazine lock button 50 when left on the firearm 40. It is lightweight, economical, and practical. It can be adapted for use with various types of firearms and can also be configured for use on a modified firearm with ambidextrous magazine release.

While the invention has been described in complete detail, it is not to be limited to such details, since many changes and modifications may be made to the invention without departing from the spirit and scope thereof. Hence, it is described to cover any and all modifications and forms, which may come within the language and scope of the appended claims.

The invention claimed is:

1. A magazine release assist tool comprising:

a) a clip having a left side wall, a right side wall, and a base member connecting the two side walls;

b) an integrated arm extension protruding from one edge of the side wall, said arm extension form a resilient flat spring having a pivot at its proximate end and a push pin at its distal end;

wherein said tool is used to release a magazine from a firearm that is equipped with a magazine release blocking mechanism.

2. The tool as specified in claim 1 wherein said clip formed a generally U-shaped spring clip.

3. The tool as specified in claim 1 wherein said clip is removably attached on a lower receiver of said firearm.

4. The tool as specified in claim 1 wherein said clip has a dimension that results in a snug fit when attached on the lower receiver of said firearm.

5. The tool as specified in claim 1 wherein said arm has a dimension that is sufficient to provide a spring action and to allow the push pin to engage a magazine release button of the firearm.

6. The tool as specified in claim 1 wherein said clip and arm extension are made from a unitary piece of spring metal including but not limited to steel or aluminum.

7. The tool as specified in claim 1 wherein said firearm is an AR-15 assault rifle.

8. The tool as specified in claim 1 wherein said magazine release blocking mechanism is a bullet Button®.

9. A tool to assist in the release of a magazine from a firearm equipped with a magazine release blocking mechanism, said tool comprising:

a) a generally U-Shaped clip removably attached to a lower receiver of a firearm, said clip comprising:
   i. a left side wall having a top edge, a bottom edge, a front edge, and a rear edge;
   ii. a right side wall having a top edge, a bottom edge, a front edge, and a rear edge;
   iii. a base member connecting the left side wall and the right side wall at their bottom edge, b) an integrated arm extension protruding from one edge of said side wall wherein said arm is immediately bent to form a curve at its proximate end to allow the arm to continue to extend in a longitudinal direction towards said magazine release blocking mechanism such that the arm form a resilient flat spring with a pivot at its proximate end and a push pin at its distal end.

10. The tool as specified in claim 9 wherein said firearm is an AR-15 semi-automatic assault rifle.

11. The tool as specified in claim 9 wherein said magazine release blocking mechanism comprises an outer stationary button and an inner magazine release button.

12. The tool as specified in claim 11 wherein said magazine release blocking mechanism is a bullet button.

13. The tool as specified in claim 9 wherein said clip is positioned adjacent to said magazine release blocking mechanism.

14. The tool as specified in claim 9 wherein said clip has a dimension that provides a snug fit when attached on the lower receiver of said firearm.

15. The tool as specified in claim 9 wherein said clip has a raised lip on the top edge of said right wall and said left wall to facilitate ease of attaching and removing the clip from the firearm.

16. The tool as specified in claim 9 wherein said arm has a dimension that is sufficient to provide a spring action and to allow the push pin to engage the magazine release button of said firearm.

17. The tool as specified in claim 9 wherein said arm extension protrudes from one edge of either the right side wall, the left side wall or both.

18. The tool as specified in claim 9 wherein said clip and said arm are made of a thin strip of metal including but not limited to steel or aluminum.

* * * * *